US009468240B2

(12) United States Patent
Lee

(10) Patent No.: US 9,468,240 B2
(45) Date of Patent: Oct. 18, 2016

(54) MATERNITY COAT

(71) Applicant: FURI DESIGN INC., Montreal (CA)

(72) Inventor: Steven Lee, Montreal (CA)

(73) Assignee: FURI DESIGN INC., Montreal (CA)

( * ) Notice: Subject to any disclaimer, the term of this patent is extended or adjusted under 35 U.S.C. 154(b) by 37 days.

(21) Appl. No.: 14/599,850

(22) Filed: Jan. 19, 2015

(65) Prior Publication Data

US 2015/0201680 A1 Jul. 23, 2015

Related U.S. Application Data

(60) Provisional application No. 61/928,743, filed on Jan. 17, 2014.

(51) Int. Cl.

| | |
|---|---|
| ***A41D 1/00*** | (2006.01) |
| ***A41D 1/20*** | (2006.01) |
| *A41D 3/02* | (2006.01) |

(52) U.S. Cl.

CPC .. *A41D 1/20* (2013.01); *A41D 3/02* (2013.01)

(58) Field of Classification Search

CPC .... A41B 3/16; A41D 27/04; A41D 2300/20; A41D 2400/482

USPC ..... 2/97, 86, 85, 93

See application file for complete search history.

(56) References Cited

U.S. PATENT DOCUMENTS

| | | | | |
|---|---|---|---|---|
| 211,426 | A * | 1/1879 | Rogers | A41D 1/02 2/93 |
| 1,010,679 | A | 5/1911 | Padernacht | |
| 1,372,977 | A * | 3/1921 | Prokesch | 2/76 |
| 2,779,944 | A * | 2/1957 | Flach | 2/85 |
| 3,230,545 | A | 1/1966 | Galley | |
| 4,606,078 | A | 8/1986 | Tkacsik | |

(Continued)

FOREIGN PATENT DOCUMENTS

| | | |
|---|---|---|
| CA | 2191660 A1 | 7/1997 |
| CA | 2643250 A1 | 5/2010 |

(Continued)

*Primary Examiner* — Andrew W Collins
*Assistant Examiner* — Brieanna Szafran
(74) *Attorney, Agent, or Firm* — Carmela De Luca; Bereskin & Parr LLP

(57) ABSTRACT

A maternity coat includes a jacket portion and a front panel portion. The jacket portion has lateral sides adapted to be fastened to each other. The front panel portion has a wide end, a narrow end, an outer layer and an inner lining. The outer layer is laterally expandable between a first lateral side and a second lateral side. The inner lining is laterally elastic between the first and second lateral sides. The front panel is further fastenable to the jacket portion in at least a first and a second configuration. In the first configuration a first side of the front panel is fastened with the first side of the jacket portion, a second side of the front panel is fastened with a second side of the jacket portion, and the wide end of the front panel is aligned with a waist end of the jacket portion. The front panel further defines a first bump proximate a waist area of the jacket portion and the inner lining is located about the waist area. In the second configuration the first side of the panel is fastened with the second side of the jacket portion, the second side of the front panel is fastened with a first side of the jacket portion, and the narrow end of the front panel is aligned with the waist end of the jacket portion. The front panel further defines a second bump proximate the chest area of the jacket and the inner lining covers the chest area.

10 Claims, 8 Drawing Sheets

(56) References Cited

U.S. PATENT DOCUMENTS

| | | | | |
|---|---|---|---|---|
| 4,683,595 | A * | 8/1987 | Cash | 2/105 |
| 5,341,514 | A | 8/1994 | Dale | |
| D608,078 | S | 1/2010 | Tranto | |
| 7,707,651 | B2 * | 5/2010 | White | 2/96 |
| 7,926,448 | B2 | 4/2011 | Fox | |
| 2008/0196140 | A1 * | 8/2008 | Mayerson et al. | 2/84 |
| 2008/0256679 | A1 | 10/2008 | White | |
| 2009/0019624 | A1 * | 1/2009 | Birk et al. | 2/455 |
| 2009/0199781 | A1 | 8/2009 | Fox | |
| 2010/0107300 | A1 | 5/2010 | Yiu | |
| 2010/0228646 | A1 | 9/2010 | Heidel | |
| 2014/0189930 | A1 * | 7/2014 | Solomon | A47D 13/025 2/69 |

FOREIGN PATENT DOCUMENTS

| | | | |
|---|---|---|---|
| CH | 703908 | * | 4/2012 |
| CN | 101874650 | A | 11/2010 |
| DE | 9401050 | * | 3/1994 |
| FR | 2993145 | * | 1/2014 |
| JP | 2012246584 | A | 12/2012 |
| WO | WO2013025757 | * | 2/2013 |

* cited by examiner

MATERNITY COAT

CROSS REFERENCE TO RELATED APPLICATIONS

The present application claims priority from U.S. provisional patent application No. 61/928,743, filed Jan. 17, 2014 and entitled "MATERNITY COAT", the disclosure of which is hereby incorporated by reference in its entirety.

FIELD

The present subject-matter relates to a maternity coat, and more particularly to a coat having a jacket portion and a front panel that are fastenable together to be worn in various configurations.

INTRODUCTION

During the course of a pregnancy, a woman will experience significant physiological changes. In particular, the size of a woman's waist area will expand over the course of the pregnancy. This may require that the woman wear clothes of differing sizes over a relatively short period of time. Having to acquire all these clothes may become expensive and time-consuming. This may be especially the case for outerwear, which are typically more expensive than other clothes and can only be worn seasonally. Furthermore, many of these clothes become unnecessary after the pregnancy when the woman's waist area has returned to its size before the pregnancy.

Additionally, when the child is born, more clothing need to be acquired for the baby, which may further increase the expenses related to the pregnancy and raising the child. In particular, the size of the child will increase as he or she grows up, which may require clothes of different sizes over a relatively short period of time.

SUMMARY

It would thus be highly desirable to be provided with a system or method that would at least partially address the disadvantages of the existing technologies.

The embodiments described herein provide in one aspect a clothing article comprising a jacket portion having first and second lateral sides adapted to be fastened to each other, a front panel portion having a wide end, a narrow end, an outer layer and an inner lining, the outer layer being laterally expandable between a first lateral side and a second lateral side, the inner lining being at least laterally elastic between the first and second lateral sides, the front panel being fastenable to the jacket portion in at least a first and a second configuration, in the first configuration a first side of the front panel being fastened with the first side of the jacket portion, a second side of the front panel being fastened with a second side of the jacket portion, and the wide end of the front panel aligning with a waist end of the jacket portion, the front panel further defining a first bump proximate a waist area of the jacket and the inner lining covering the waist area, and in the second configuration the first side of the front panel being fastened with the second side of the jacket portion, the second side of the front panel being fastened with a first side of the jacket portion, and the narrow end of the front panel aligning with the waist end of the jacket portion, the front panel further defining a second bump proximate the chest area of the jacket and the inner lining covering the chest area.

The embodiments described herein provide in another aspect a kit comprising the jacket portion and the front panel described above.

DRAWINGS

For a better understanding of the embodiments described herein and to show more clearly how they may be carried into effect, reference will now be made, by way of example only, to the accompanying drawings which show at least one exemplary embodiment, and in which.

DESCRIPTION OF VARIOUS EMBODIMENTS

Figure 1:
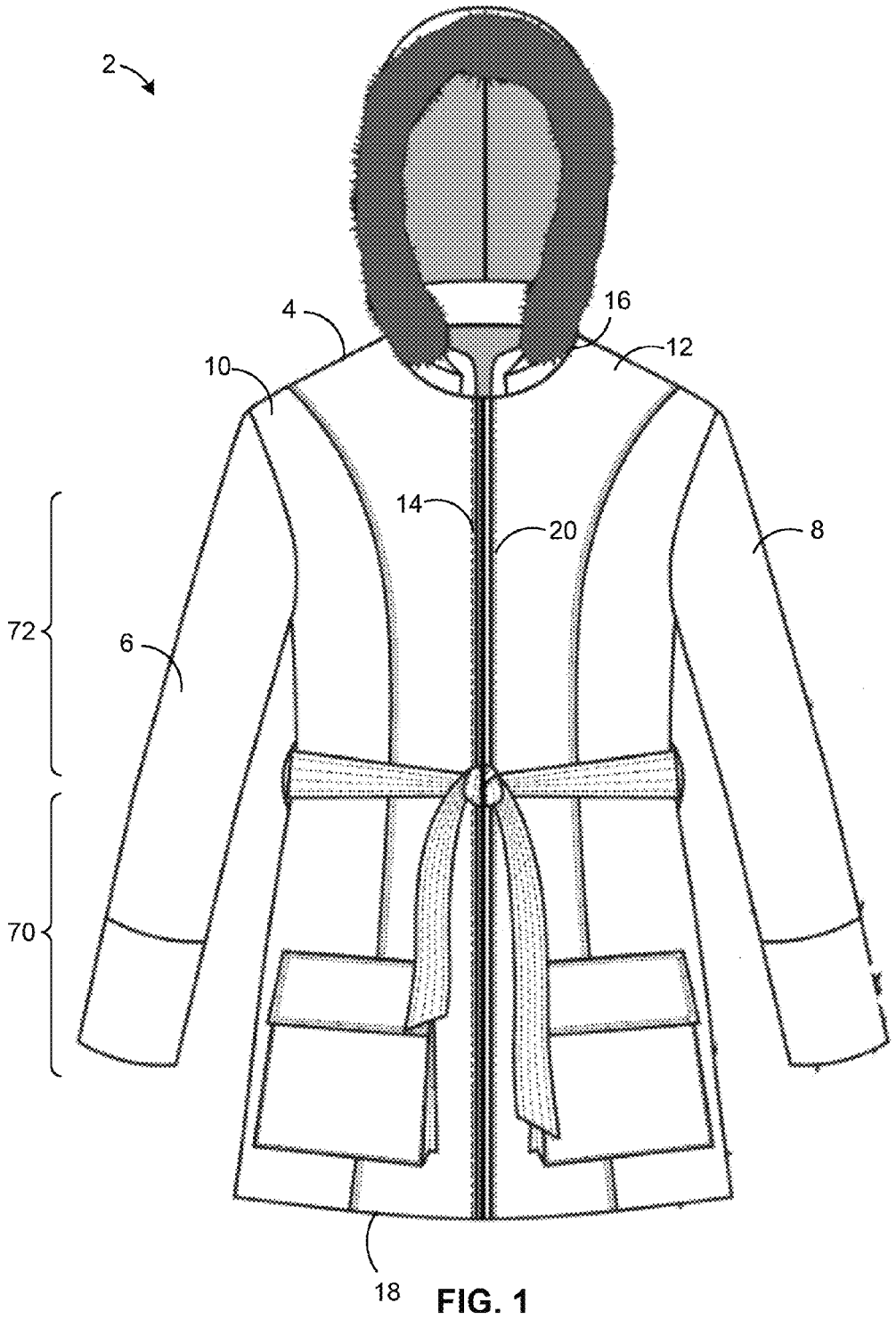
FIG. 1 illustrates a front elevation view of a jacket portion according one of various exemplary embodiments.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

Referring now to FIG. 1, therein illustrated is a front elevation view of a jacket portion 2 of a maternity coat 4 according to various exemplary embodiments. The jacket portion 2 may be an outerwear coat, such as a fall coat or winter coat, which may be worn about the upper body of a person. The jacket portion 2 includes a right sleeve 6 and a left sleeve 8 which extend respectively from a right panel 10 and a left panel 12. A right lateral side 14 of the right panel 10 extends from a collar end 16 to a waist end 18 of the jacket portion 2. A left lateral side 20 of the left panel 12 also extends from the collar end 16 to the waist end 18 of the jacket portion 2.

One or more fasteners of the right lateral side 14 can be fastened to one or more fasteners of the left lateral side 20. Unfastening the fasteners allows the jacket portion 2 to be left open and fastening the fasteners closes the jacket portion 2. For example, the fasteners of the right lateral side 14 and left lateral side 20 can be zip fasteners.

Figure 2:
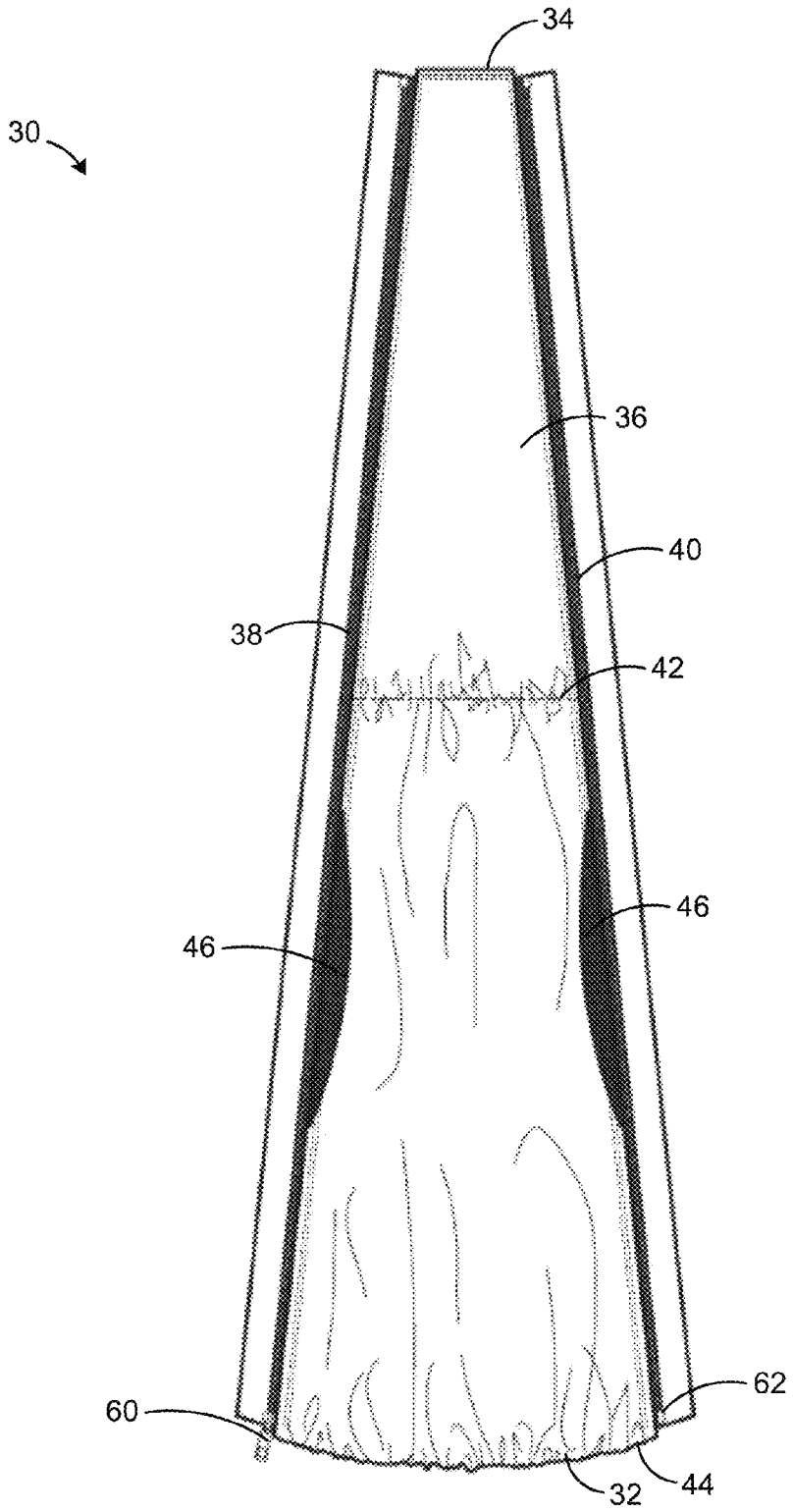
FIG. 2 illustrates a front elevation view of a front panel according to the one of various exemplary embodiments.

Referring now to FIG. 2, therein illustrated is front elevation view of a front panel 30 according to various exemplary embodiments. The front panel 30 has a generally elongated shape having a wide end 32 and a narrow end 34. The front panel 30 further has opposing first side 38 and second side 40. For example, the front panel 30 may have a generally trapezoidal shape defined by the wide end 32, narrow end 34 and opposing first side 38 and second side 40 corresponding to the legs of the trapezoid. The first side 38 and the second side 40 may have the same length. For example, the length of the first side 38 and the length of the second side 40 may be equal to the length of the lateral side 14 of the right panel 10 of the jacket portion 2 and the lateral side of the left panel 12 of the jacket portion 2. The length of the lateral sides of either one of the right panel 10 or left panel 12 is defined by the distance between the collar end 16 and the waist end 18.

The front of the front panel 30 as illustrated in FIG. 2 corresponds to an outer surface of the front panel 30. An outer layer 36 substantially covers the entire area of the outer surface of the front panel 30. For example, the outer layer 36 may be formed of a material that is resistant to weather forces. For example the outer layer 36 may be water resistant and/or restricts passage of air to "break" the wind.

Along at least a portion of its length, the front panel 30 is laterally expandable between the first and second sides 38, 40. For example, at least a portion of the outer layer 36 of the front panel 30 is shirred to provide lateral expandability. For example, a first transverse elastic stitch 42 located intermediate the narrow end 34 and wide end 32 provides shirring of the outer layer 36 at a location along the length of the front panel 30. For example, an additional second transverse elastic stitch 44 may be located at or near the wide end 32 to provide shirring of a portion of the outer layer 36 near the wide end 32 of the front panel 30. Accordingly, a lower portion of the first panel 30 is shirred. Between the first transverse elastic stitch 42 and the second transverse elastic stitch 44, the outer layer 36 may have a width that is greater than the corresponding width of the front panel 30. When the transverse elastic stitches 42, 44 are in a relaxed (non-stretched) state, the outer layer 36 may be in a pleated state. Lateral stretching of one or more of the first transverse elastic stitch 42 and second transverse elastic stitch 44 causes the pleated portion of the outer layer 36 to become less pleated and to expand laterally.

According to various exemplary embodiments, the outer layer 36 of the front panel 30 has formed therein at least one pocket 46. The at least one pocket 46 is formed generally towards the wide end 32 of the front panel 30. For example the at least one pocket 46 may be located along the length of the front panel 30 between the first transverse stitch 42 and the second transverse stitch 44. For example the at least one pocket may be a kangaroo pocket extending between the two sides 38, 40 of the front panel 30. For example, the outer layer 36 may be lined with insulating material to improve thermal insulation.

Figure 3:
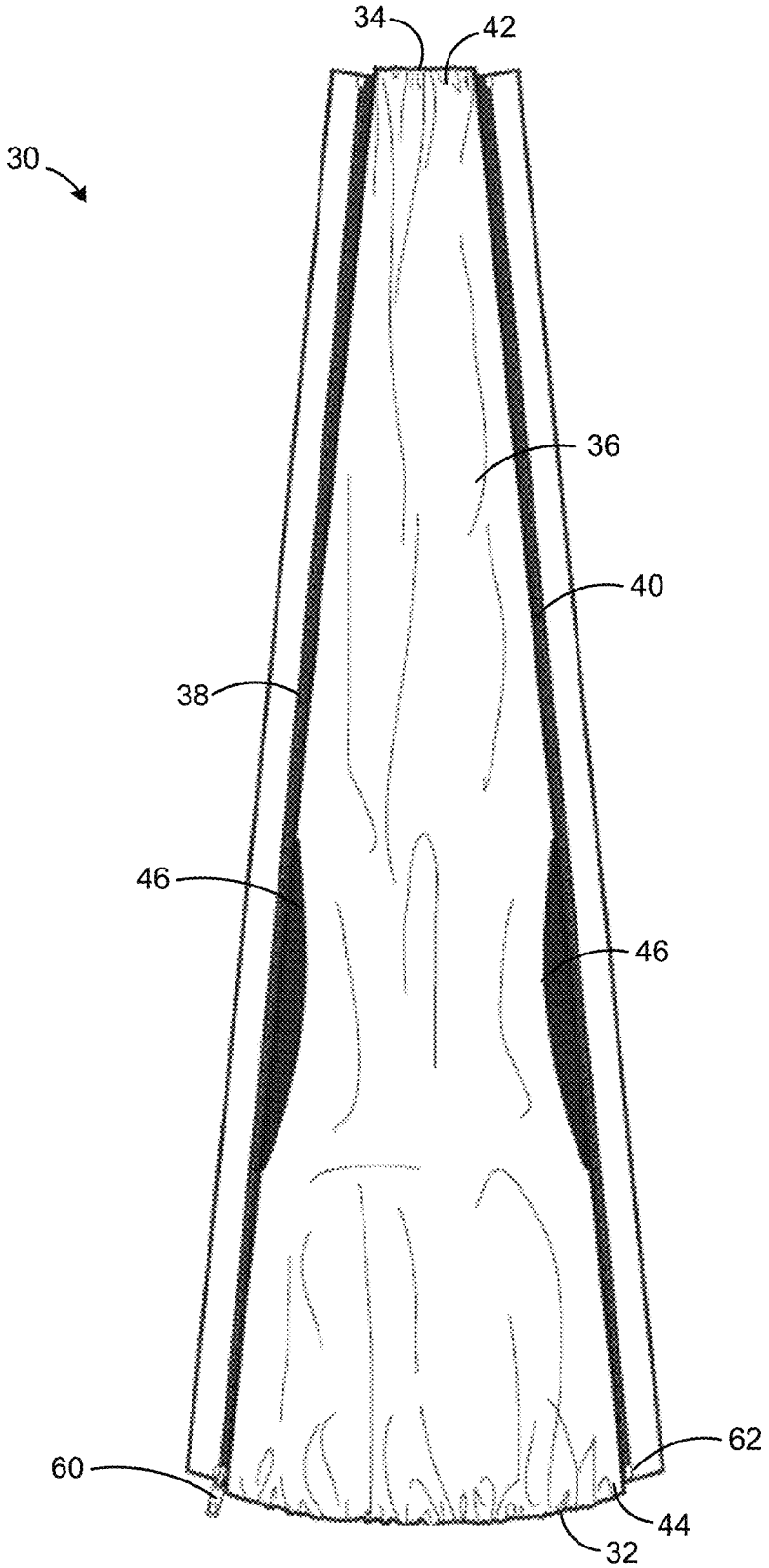
FIG. 3 illustrates a front elevation view of a front panel according to an alternative exemplary embodiment.

Referring now to FIG. 3, therein illustrated is front elevation view of the front panel 30 according to an alternative exemplary embodiment. Accordingly, the first transverse elastic stitch 42 is located at or near the narrow end 34 of the front panel 30 and provides shirring of a portion of the outer layer 36 near the narrow end 34. The second transverse elastic stitch 44 is located at or near the wide end 32 of the front panel 30 and provides shirring of the portion of the outer layer 36 near the wide end 32. Accordingly, the whole of the outer layer 36 may be shirred.

Figure 4A:
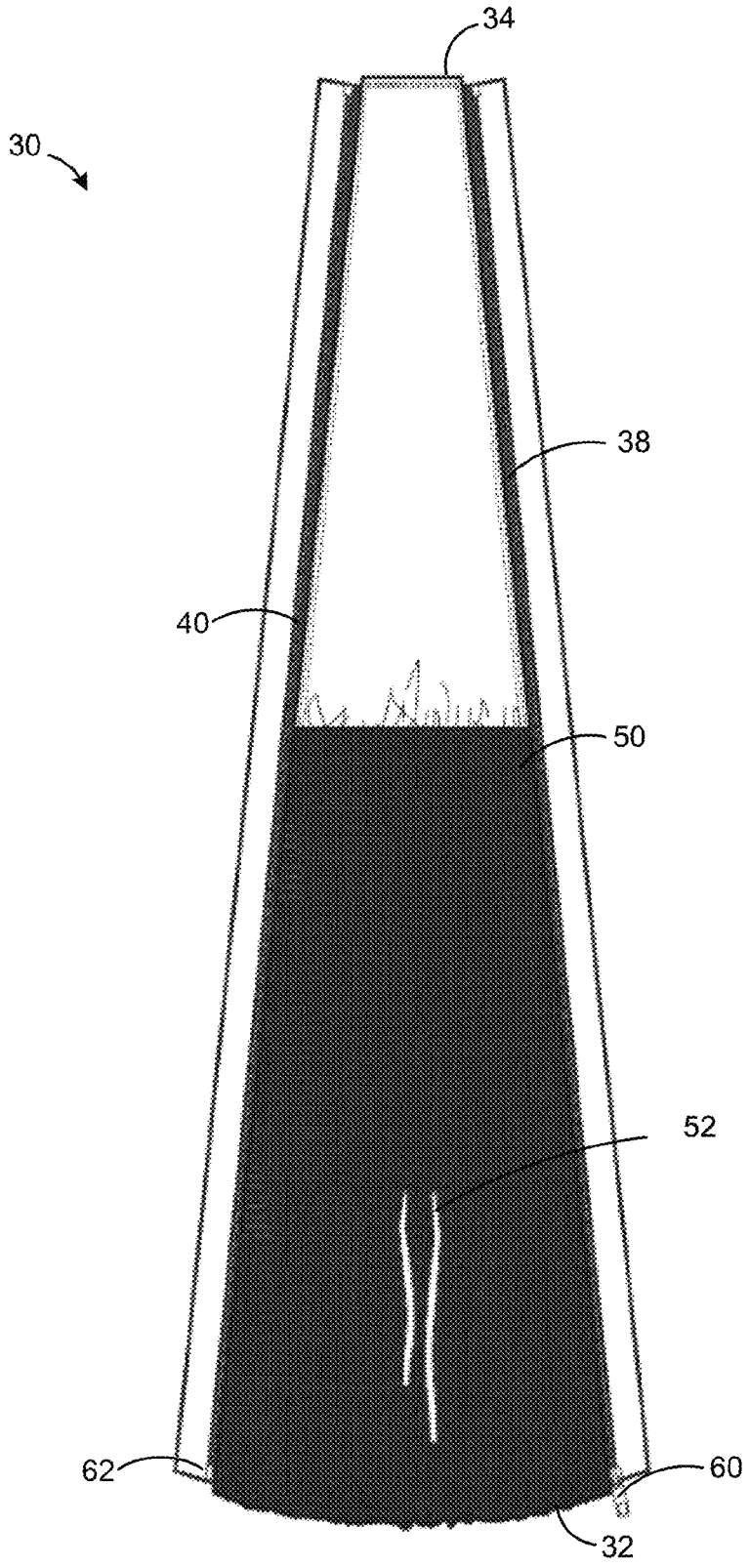
FIG. 4A illustrates a rear elevation view of a front panel according to the one of various exemplary embodiments.

Referring now to FIG. 4, therein illustrated is a rear elevation view of the front panel 30 according to various exemplary embodiments. The rear of the front panel 30 corresponds to an inner surface of the front panel 30. At least a portion of the inner surface of the front panel 30 is covered by an inner lining 50. The inner lining 50 may be laterally elastic between the first side 38 and second side 40 of the front panel 30. For example the inner lining 50 may be further longitudinally elastic in a direction between the narrow end 34 and the wide end 32. For example, the inner lining 50 may be formed of a rib knit providing at least lateral elasticity. The inner lining 50 may be formed of a material that provides heat insulation such as partial cotton, polyester, or acrylic According to the example shown in FIG. 4A, the inner lining 50 extends over a portion of the length of the front panel 30. For example, the inner lining 50 may extend over a lower portion of the front panel 30 further extending from the wide end 32 of the front panel 30. For example, the length of the inner lining 50 in the direction between the narrow end 34 and the wide end 32 corresponds to the length of a portion of the outer layer 36 between the first transverse stitch 42 positioned at an intermediate length of the front panel 30 and the second transverse stitch 44. For example the first and second transverse stitches 42, 44 can join the inner lining 50 with the outer layer 36 of the front panel 30.

Figure 4B:
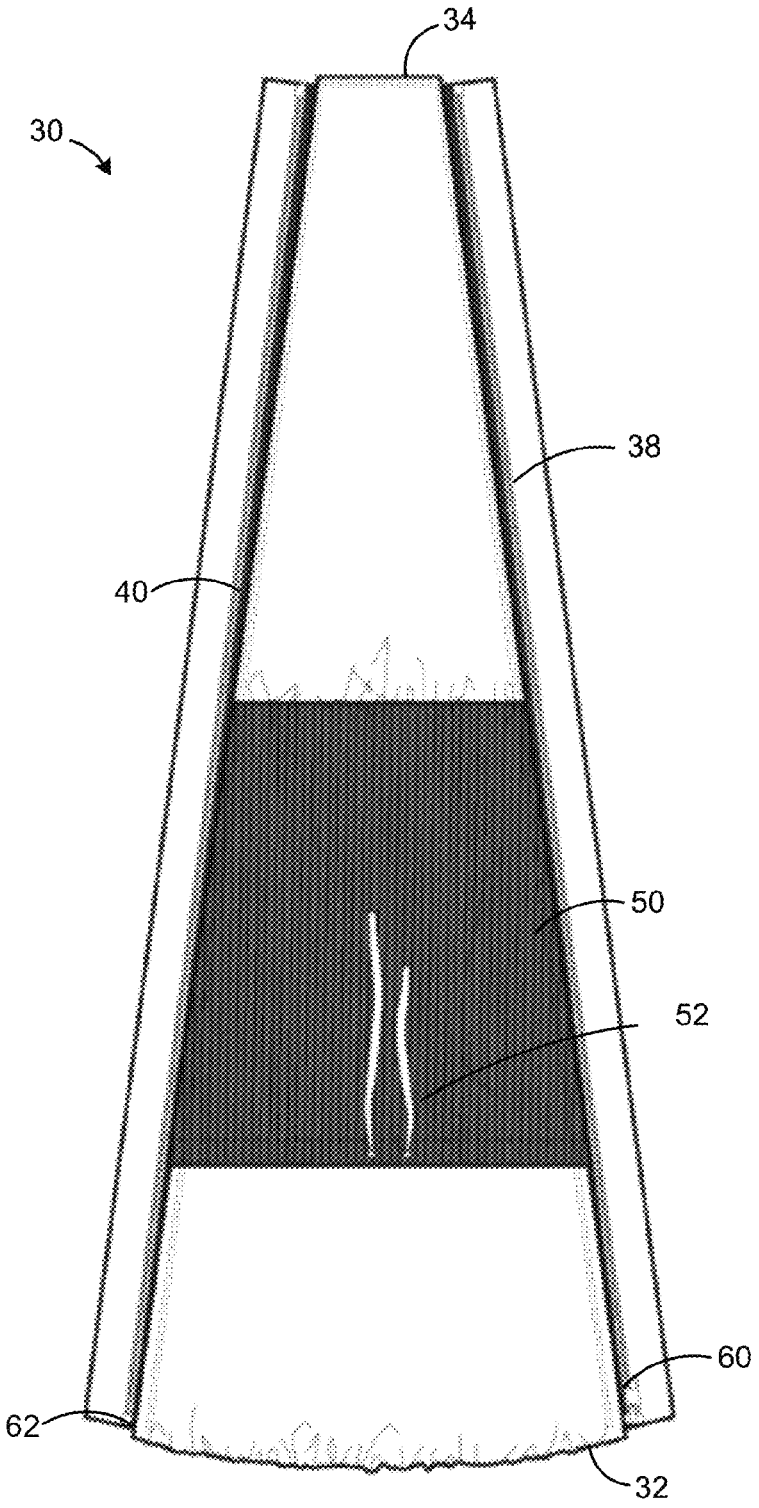
FIG. 4B illustrates a rear elevation view of a front panel according to one alternative exemplary embodiment.

Referring now to FIG. 4B, according to an alternative, the inner lining 50 extends over an intermediate portion of the length of the front panel 30 wherein a lower lateral edge of the lining 50 is spaced apart from the wide end 32 and an upper lateral edge of the lining is spaced apart from the narrow end 34.

According to one exemplary embodiment, the inner lining 50 further includes a drawstring 52 that extends between the first and second sides 38, 40 of the front panel 30. Adjustment of the exposed portion of the drawstring 52 causes adjustment of a maximum width of the front panel 30.

Figure 5:
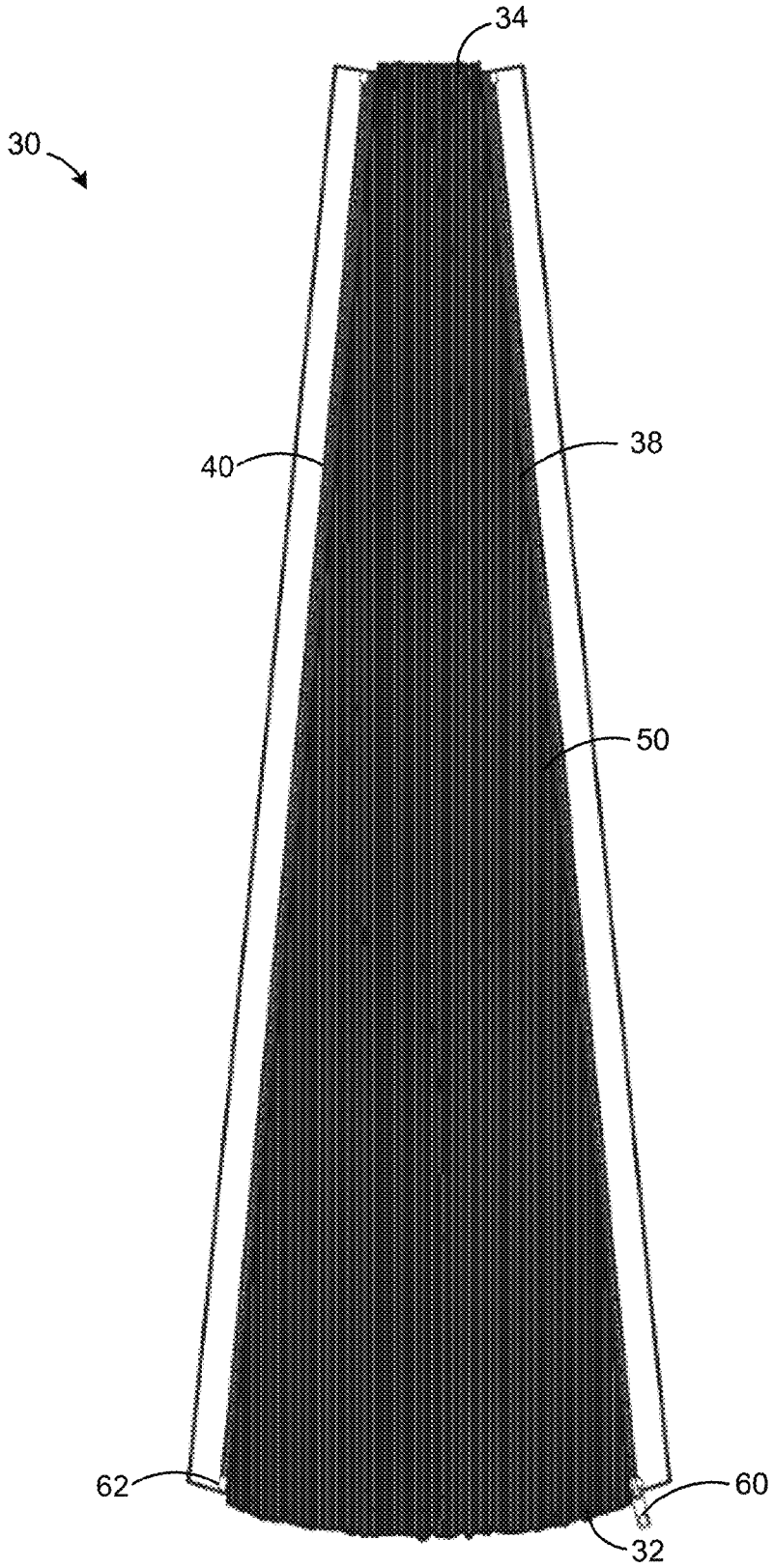
FIG. 5 illustrates a rear elevation view of a front panel according to one alternative exemplary embodiment.

Referring now to FIG. 5, therein illustrated is a rear elevation view of the front panel 30 according to yet another alternative exemplary embodiment. According to the yet another alternative exemplary embodiment, the inner lining 50 extends over substantially the entire length of the front panel 30 and between the narrow end 34 and the wide end 32.

Referring back to FIGS. 2-5, the first side 38 of the front panel 30 has one or more fasteners 60 extending along the length of the first side 38 between the wide end 32 and the narrow end 34. The second side 40 of the front panel 30 also has one or more fasteners 62 extending along the length of the second side 40 between the wide end 32 and the narrow end 34. For example, the first fasteners 60 and second fasteners 62 can be of the zip fastener type but may be any other suitable type of fastener known in the art.

The front panel 30 may be joined with the jacket portion 2 in at least two configurations.

Figure 6:
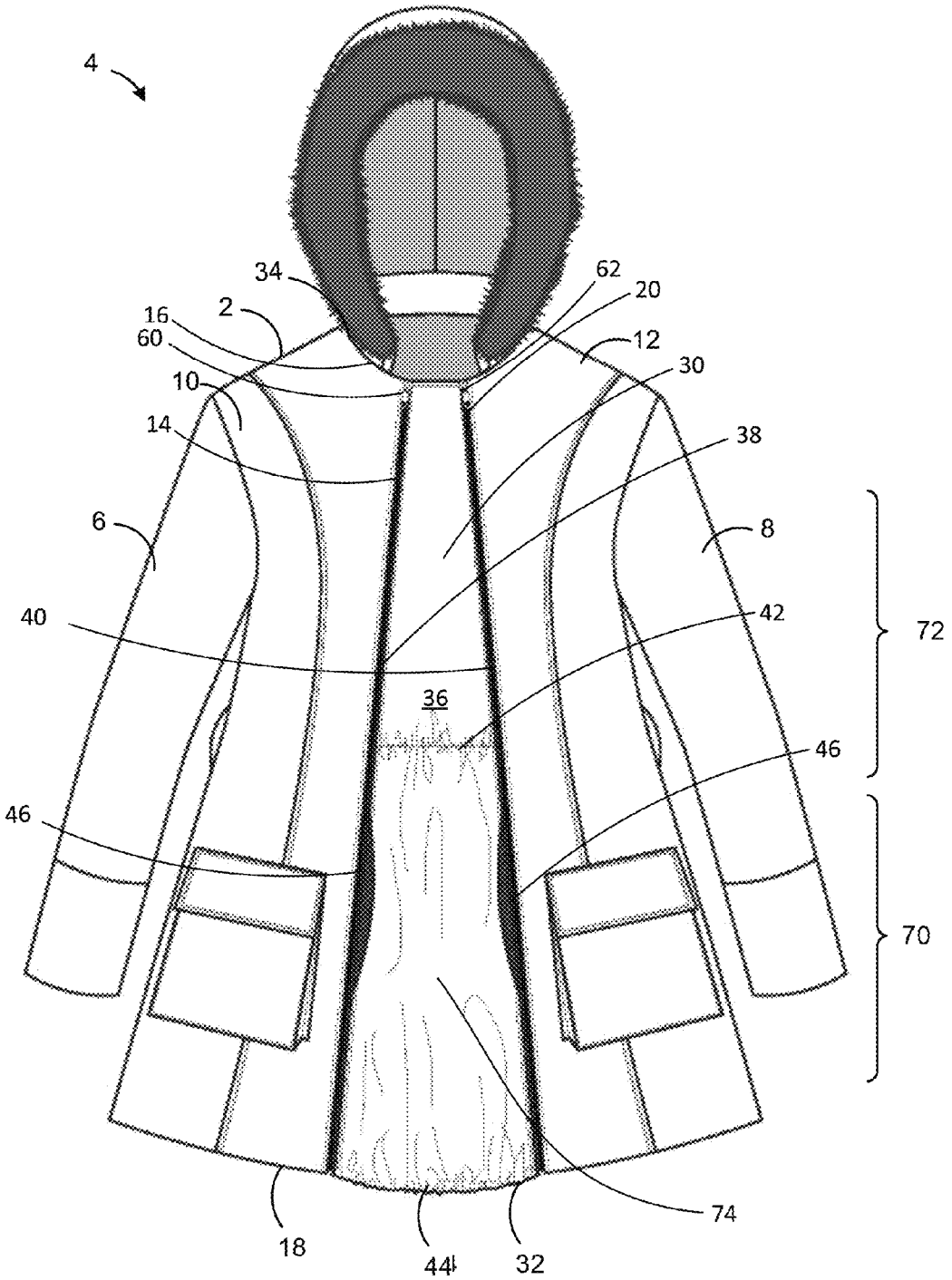
FIG. 6 illustrates a front elevation view of a maternity coat formed from joining of a jacket portion and a front panel according to a first exemplary configuration.

Referring now to FIG. 6, therein illustrated is a front elevation view of an exemplary maternity coat 4 formed from the assembly of the jacket portion 2 with the front panel 30 according to a first configuration. According to the first configuration, the first side 38 of the front panel 30 is joined with the lateral side 14 of the right panel 10 of the jacket portion 2. For example, first fasteners 60 of the first side 38 of the front panel 30 can be fastened to fasteners of the lateral side 14 of the right panel 10. The second side 40 of the front panel 30 is further joined with the lateral side 20 of the left panel 12 of the jacket portion 2. For example, second fasteners 62 of the second side of the front panel 30 can be fastened to fasteners of the lateral side 20 of the left panel 12 of the jacket portion 2.

When the front panel 30 is joined to the jacket portion 2 in the first configuration, the narrow end 34 of the front panel 30 aligns with the collar end 16 of the jacket portion 2 and defines a neck opening. It will be appreciated that due to the addition of the front panel 30 between the lateral sides 14 and 20, the neck opening defined in the first configuration may be larger than the neck opening defined by the collar end 16 when only the lateral sides 14 and 20 are directly fastened together. Furthermore, when the front panel 30 is joined to the jacket portion 2 in the first configuration, the wide end 32 of the front panel 30 aligns with the waist end 18 of the jacket portion 2 and defines the waist opening of the maternity coat 4. It will be appreciated that due to the addition of the front panel 30 between the lateral sides 14 and 20, the waist opening defined in the first configuration is larger than the waist opening defined by the waist end 18 when only the lateral side 14 and 20 are fastened together.

The assembly of the front panel 30 with the jacket portion 2 according to the first configuration causes the assembled maternity coat 4 to have a larger fit, which allows a person having a larger body size to wear the maternity coat 4. Since the portion of the front panel 30 near the wide end 32 is wider than the portion of the front panel 30 near the narrow end 34, the resulting maternity coat 4 is expanded by a larger proportion at its waist area 70 than the expansion at its chest area 72. Being placed between the right panel 10 and left panel 12 of the jacket portion 2, the front panel 30 defines a first bump 74 at the waist area 70 of the jacket portion 2.

In the first configuration, the inner lining 50 of the front panel 30 forms part of the inner surface of the maternity coat 4. Furthermore, at least a portion of the inner lining 50 is located about the waist area 70 of the maternity coat 4.

When the maternity coat 4 formed from assembly of the jacket portion 2 and the front panel 30 into the first configuration is worn by a pregnant woman, the belly of the pregnant woman can be received within the first bump 74 defined at the waist area 70 of the jacket portion 2. Furthermore, the inner lining 50 of the front panel 30 can be located about the belly of the pregnant woman. This position of the inner lining 50 provides thermal insulation, thereby aiding in retaining warmth of the belly of the pregnant woman.

The inner lining 50 further stretches laterally about the belly of the pregnant woman. According to some exemplary embodiments, the inner lining 50 may further stretch longitudinally about the belly of the pregnant woman. The stretching of the inner lining 50 provides a snug fit of the waist area 70 of the maternity coat 4 about the waist of the woman. The lateral elasticity of the inner lining 50 allows the size of the front panel 30 to adapt to a varying size of the belly of the pregnant woman over the course of the pregnancy. The drawstring 52 may further be used to adjust the size and fit of the maternity coat 4.

As the inner lining 50 stretches at least in the lateral direction about the belly of the pregnant woman, the outer layer 36 also expands laterally to accommodate the belly. As the outer layer 36 expands laterally, it becomes less pleated. The first transverse elastic stitch 42 and/or the second transverse elastic stitch 44 also stretches laterally to accommodate the belly of the pregnant woman while maintaining a snug fit of the outer layer 36 about the belly. The lateral elasticity of the first transverse elastic stitch 42 and/or second transverse elastic stitch 44 allows the size of the outer layer 36 of the front panel 30 to adapt to the varying size of the belly of the pregnant woman over the course of the pregnancy.

According to various exemplary embodiments, the at least one pocket 46 formed on the outer layer 36 of the front panel 30 is located about the first bump 74 defined at the waist area 70 of the maternity coat 4. Accordingly, when the maternity coat 4 formed from the assembly of the jacket portion 2 and the front panel 30 into the first configuration is worn by the pregnant woman, the at least one pocket 46 is located about the belly of the pregnant woman. The at least one pocket 46 allows the woman's hands that are inserted in the at least one pocket 46 to be kept warm. The at least one pocket 46 further allows the woman's hands to caress the pregnant belly. It will be appreciated that caressing the belly is an action done by many soon-to-be mothers and may promote bonding of a soon-to-be mother with her future newborn.

Figure 7:
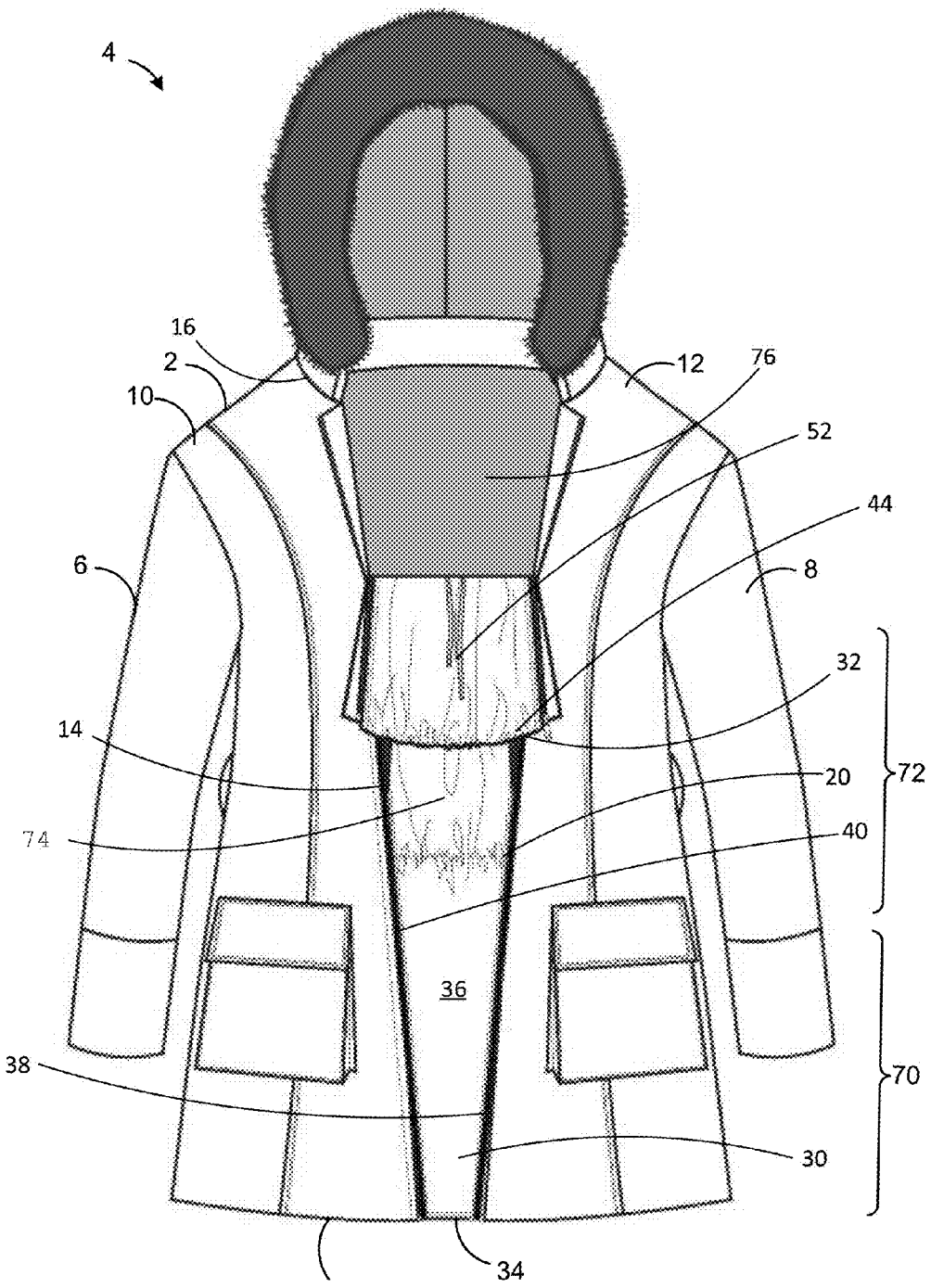
FIG. 7 illustrates a front elevation view of a maternity coat formed from joining of a jacket portion and a front panel according to a second exemplary configuration.

Referring now to FIG. 7, therein illustrated is a front elevation view of the exemplary maternity coat 4 formed from the assembly of the jacket portion 2 with the front panel 30 according into a second configuration. According to a second configuration, the first side 38 of the front panel 30 is joined with the lateral side 20 of the left panel 12 of the jacket portion 2. For example, first fasteners 60 of the first side 38 of the front panel 30 can be fastened to fasteners of the lateral side 20 of the left panel 12. The second side 40 of the front panel 30 is further joined with the lateral side 14 of the right panel 10. For example, second fasteners 62 of the second side 40 of the front panel 30 can be fastened to fasteners of the lateral side 14 of the right panel 10 of the jacket portion 2. When the front panel 30 is joined to the jacket portion 2 in the second configuration, the narrow end 34 of the front panel 30 aligns with the waist end 18 of the jacket portion 2. It will be appreciated that the waist opening in the second configuration is larger than the waist opening defined when lateral sides 14 and 20 are fastened together but is smaller than the waist opening formed in the first configuration. Furthermore, when the front panel 30 is joined to the jacket portion 2 in the second configuration, the wide end 32 of the front panel 30 is located near the collar end 16 of the jacket portion 2.

According to various exemplary embodiments, a portion of the front panel 30 can be opened from the collar end 16 of the jacket portion 2. For example the portion of the front panel 30 near the wide end 32 of the front panel 30 may be folded outwardly to expose an opening 76 near the collar end 16 of the jacket portion 2.

For example, where the fasteners 60 and 62 of the first and second sides of the front panel 30 are zip fasteners, these zip fasteners are oriented to open from the collar end 16 of the jacket portion 2 so as to allow a portion of the front panel 30 near the wide end 32 to be opened first.

Generally, the assembly of the front panel 30 with the jacket portion 2 into the second configuration causes the resulting maternity coat 4 to have a smaller fit about waist area 70 than the maternity coat 4 formed by the front panel 30 and the jacket portion 2 in the first configuration. The maternity coat 4 formed in the second configuration can be worn by a woman in the post natal period when the size of the belly of the woman begins to gradually decrease.

The maternity coat 4 resulting from the joining of the front panel 30 with the jacket portion 2 in the second configuration results in the chest area 72 of the maternity coat 4 to be expanded by larger proportion than the expansion at the waist area 70. Being placed between the right panel 10 and the left panel 12 of the jacket portion 2, the front panel 30 defines a second bump 74 near the chest area 72 of the jacket portion 2.

When the maternity coat 4 is worn by the woman, the expanded chest area 72 of the maternity coat 4 allows an infant to be placed near the chest of the woman and at least partially underneath the maternity coat 4. Typically, the infant is placed to face the mother wearing the maternity coat 4, thereby further promoting interaction between the infant and the mother.

When the maternity coat 4 formed from the arrangement of the jacket portion 2 and the front panel 30 in the second configuration is worn by the woman carrying the infant in the chest area 72, the inner lining 50 of the front panel 30 is located about the body of the infant. For example, when the front panel 30 is appropriately fastened to the left and right panels 10 and 12 of the jacket portion 2, the inner lining 50 can be placed to cover a backside of the infant. This position of the inner lining 50 provides thermal insulation, thereby aiding in retaining warmth of the infant being carried.

In second configuration, the inner lining 50 stretches laterally about the body of the infant being carried and the chest of the woman wearing the maternity coat 4. According to some exemplary embodiments, the inner lining 50 may be further stretched longitudinally about the body of the infant. The stretching of the inner lining 50 provides a snug fit of the chest area 72 of the maternity coat 4 about the infant and chest of the woman wearing the maternity coat 4. The lateral elasticity of the inner lining 50 allows the size of the front panel 30 to be adapted to the varying size of the infant as he or she grows up. The drawstring 52 can further be used to adjust the size and fit of the maternity coat 4.

As the inner lining 50 stretches at least laterally about the infant, the outer layer 36 also expands laterally to accommodate the newborn or infant. As the outer layer 36 expands laterally, it becomes less pleated. The first transverse elastic stitch 42 and/or the second transverse elastic stitch 44 also stretches laterally to accommodate the infant while maintaining a snug fit of the outer layer 36 about the infant. The lateral elasticity of the first transverse elastic stitch 42 and/or second transverse elastic stitch 44 allows the size of the outer layer 36 of the front panel 30 to adapt to the varying size of the infant of as he or she grows up.

According to one exemplary embodiment, the jacket portion 2 described herein according to various exemplary embodiments and the front panel 30 described herein according to various exemplary embodiments may be provided as a kit.

Advantageously, the at least laterally expandable outer layer 36 and the at least laterally elastic inner lining 50 allows the maternity coat 4 to be comfortably worn by a pregnant woman throughout her pregnancy despite changes to her physique during the pregnancy. For example, and as discussed above, the stretching of the inner lining 50 provides a snug fit of the waist area 70 of the maternity coat 4 about the waist of the pregnant woman. Advantageously, the at least laterally expandable outer layer 36 and the at least laterally elastic inner lining 50 further allows the maternity coat 4 to be comfortably worn during the pre-natal period while carrying an infant about the chest area. For example, the stretching of the inner lining 50 provides a snug for the infant as the infant grows in size.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the embodiments and non-limiting, and it will be understood by persons skilled in the art that other variants and modifications may be made without departing from the scope of the embodiments as defined in the claims appended hereto.

The invention claimed is:

1. A maternity coat comprising:

a jacket portion having first and second lateral sides adapted to be fastened to each other;

a front panel portion having a wide end, a narrow end, an outer layer and an inner surface, the outer layer being laterally expandable between a first lateral side and a second lateral side, the inner surface having an inner lining, formed of a rib knit being at least laterally elastic between the first and second lateral sides, the front panel being fastenable to the jacket portion in at least a first configuration and a second configuration;

in the first configuration a first side of the front panel being fastened with the first side of the jacket portion, a second side of the front panel being fastened with a second side of the jacket portion, and the wide end of the front panel aligning with a waist end of the jacket portion, the front panel further defining a bump in a first configuration proximate a waist area of the jacket and the inner lining being located about the waist area of the jacket; and in the second configuration the first side of the front panel being fastened with the second side of the jacket portion, the second side of the front panel being fastened with a first side of the jacket portion, and the narrow end of the front panel aligning with the waist end of the jacket portion, the front panel further defining the bump in a second configuration proximate a chest area of the jacket portion and the inner lining covering the chest area;

wherein the outer layer of the front panel portion further comprises at least one pocket positioned at an intermediate distance between the wide end and the narrow end of the front panel and configured for receiving a hand of a wearer;

wherein the inner surface of the front panel further comprises a drawstring, a first transverse elastic stitching positioned at a first intermediate position between the wide and narrow ends and corresponding to an upper lateral edge of the rib knit inner lining, the first transverse elastic stitching providing shirring to the outer layer of the front panel portion, and a second transverse elastic stitching positioned at a second intermediate position at the wide end and corresponding to a lower lateral ledge of the rib knit inner lining, the second transverse elastic stitching providing shirring to a portion of the outer layer of the front panel near the wide end;

wherein the rib knit inner lining extends between the first and second lateral sides of the front panel and between the first and second transverse stitches;

wherein the drawstring is positioned at an intermediate distance between the lower lateral edge and the upper lateral edge of the rib knit inner lining; and wherein the upper lateral edge of the rib knit inner lining substantially corresponds to a midpoint of the front panel's length between its wide and narrow ends;

wherein the at least one pocket extends between the first and second lateral sides of the front panel portion; and wherein the at least one pocket is positioned at an intermediate distance between the lower lateral edge and the upper lateral edge of the rib knit inner lining.

2. The maternity coat of claim 1, wherein the inner lining is a thermally insulating layer.

3. The maternity coat of claim 1, wherein when the coat is worn in the first configuration, the rib knit inner lining stretches laterally and the outer layer expands laterally to adaptively receive a baby bump of the wearer; and wherein when the coat is worn in the second configuration, the rib knit inner lining stretches laterally and the outer layer expands laterally to adaptively receive a baby within the second bump.

4. The maternity coat of claim 1, wherein the inner lining covers a sub-portion of an inner surface of the front panel, the sub-portion configured to correspond to a baby bump of the wearer when the coat is worn in the first configuration and wherein the sub-portion corresponds to a chest area of the wearer when the coat is worn in the second configuration.

5. The maternity coat of claim 1, wherein the at least one pocket is a kangaroo pocket.

6. A maternity coat comprising:

a jacket portion having first and second lateral sides adapted to be fastened to each other;

a front panel portion having a wide end, a narrow end, an outer layer and an inner surface, the outer layer being laterally expandable between a first lateral side and a second lateral side, the inner surface having an inner lining, formed of a rib knit being at least laterally elastic between the first and second lateral sides, the front panel being fastenable to the jacket portion in at least a first configuration and a second configuration;

in the first configuration a first side of the front panel being fastened with the first side of the jacket portion, a second side of the front panel being fastened with a second side of the jacket portion, and the wide end of the front panel aligning with a waist end of the jacket portion, the front panel further defining a bump in a first configuration proximate a waist area of the jacket and the inner lining being located about the waist area of the jacket; and in the second configuration the first side of the front panel being fastened with the second side of the jacket portion, the second side of the front panel being fastened with a first side of the jacket portion, and the narrow end of the front panel aligning with the waist end of the jacket portion, the front panel further defining the bump in a second configuration proximate a chest area of the jacket portion and the inner lining covering the chest area;

wherein the outer layer of the front panel portion further comprises at least one pocket positioned at an intermediate distance between the wide end and the narrow end of the front panel and configured for receiving a hand of a wearer;

wherein the inner surface of the front panel further comprises a drawstring, a first transverse elastic stitching positioned at a first intermediate position between the wide and narrow ends and corresponding to an upper lateral edge of the rib knit inner lining, the first transverse elastic stitching providing shirring to the outer layer of the front panel portion, and a second transverse elastic stitching positioned at a second intermediate position spaced apart from the wide end and corresponding to a lower lateral ledge of the rib knit inner lining, the second transverse elastic stitching providing shirring to a portion of the outer layer of the front panel near the wide end;

wherein the rib knit inner lining extends between the first and second lateral sides of the front panel and between the first and second transverse stitches;

wherein the drawstring is positioned at a lower lateral ledge of the rib knit inner lining; and wherein the upper lateral edge of the rib knit inner lining substantially corresponds to a midpoint of the front panel's length between its wide and narrow ends;

wherein the at least one pocket extends between the first and second lateral sides of the front panel portion; and wherein the at least one pocket is positioned at an intermediate distance between the lower lateral edge and the upper lateral edge of the rib knit inner lining.

7. The maternity coat of claim 6, wherein the inner lining is a thermally insulating layer.

8. The maternity coat of claim 6, wherein when the coat is worn in the first configuration, the rib knit inner lining stretches laterally and the outer layer expands laterally to adaptively receive a baby bump of the wearer; and wherein when the coat is worn in the second configuration, the rib knit inner lining stretches laterally and the outer layer expands laterally to adaptively receive a baby within the second bump.

9. The maternity coat of claim 6, wherein the inner lining covers a sub-portion of an inner surface of the front panel, the sub-portion configured to correspond to a baby bump of the wearer when the coat is worn in the first configuration and wherein the sub-portion corresponds to a chest area of the wearer when the coat is worn in the second configuration.

10. The maternity coat of claim 6, wherein the at least one pocket is a kangaroo pocket.

* * * * *